United States Patent [19]

Swann et al.

[11] 4,021,189

[45] May 3, 1977

[54] GAS BURNER

[75] Inventors: Ferris George Swann; Martin Josef Beckmann, both of Edmonton, Canada

[73] Assignee: Porta-Test Manufacturing Ltd., Edmonton, Canada

[22] Filed: Jan. 16, 1975

[21] Appl. No.: 541,532

[52] U.S. Cl. ..... 431/202; 239/DIG. 7; 239/424

[51] Int. Cl.[2] ..... F23D 13/20

[58] Field of Search ..... 431/202, 89, 284; 239/424, DIG. 7

[56] References Cited

UNITED STATES PATENTS

| | | | |
|---|---|---|---|
| 3,315,726 | 4/1967 | Williams | 431/89 |
| 3,419,338 | 12/1968 | Schreter et al. | 431/284 |
| 3,833,337 | 9/1974 | Desty | 431/202 X |
| 3,915,622 | 10/1975 | Desty et al. | 431/284 |

*Primary Examiner*—Edward G. Favors

*Attorney, Agent, or Firm*—E. P. Johnson

[57] ABSTRACT

The burner comprises a tubular flow conduit which is attached to the end of a flare line so that combustible gas passes therethrough. The end face of the conduit forms an annular valve seat. A tulip-shaped valve body seats in the valve seat and can be displaced axially by the gas to open the conduit outlet as required while maintaining a back pressure in the flare line. Minute passages, such as transverse notches extending across the valve seat, are provided to permit gas, flowing at a low rate, to escape from the flow conduit when the valve body is seated. The rounded shape of the valve body induces the gas to form an attached jet which clings to the valve body surface and creates a low pressure zone at said surface. Air is therefore drawn toward the surface to mix with the gas and form a mixture adapted to burn smokelessly. The burner is able to accomodate various rates of flow while maintaining a stable flame.

2 Claims, 7 Drawing Figures

GAS BURNER

BACKGROUND OF THE INVENTION

This invention relates to a burner adapted to be used on gas flare stacks and the like.

The burner has been developed in conjunction with plants using natural gas as a feed stock. These plants can have waste gas flows varying, for example, from 50,000 cu. ft./day under normal operating conditions to perhaps 20 million cu. ft./day when plant upsets occur. These waste gases are flared to the atmosphere.

In this service there is a need for a burner which: (1) is capable of accommodating a wide range of flow rates, such as those illustrated in the preceding paragraph; (2) can burn the gas substantially smokelessly, to meet environmental requirements; and (3) is mechanically simple and durable so that maintenance is minimal.

SUMMARY OF THE INVENTION

In accordance with the invention, a burner is provided comprising a tubular flow conduit which is connected to the flare conduit to form an extension thereof. The flow conduit includes a valve seat at its outlet end. A specially shaped valve body is positioned at the flow conduit outlet. This valve body seats in the valve seat, to restrict the flow of combustible gas therethrough, and may be displaced axially from the seat as the gas flow and back pressure increase, thereby reducing the back pressure. The burner includes one or more minute passages which permit a small gas flow to escape from the flow conduit at high velocity when the valve body is seated. For example, the passages may consist of notches formed in the flow conduit and extending transversely across the valve seat. Thus a relatively high velocity flow of gas from the flow conduit is maintained at all times. The valve body is preferably tulip-shaped, having a solid surface at its base. The surface extends outwardly from the longitudinal axis of the flow conduit and curves to extend in the direction of said axis. This surface deflects the gas jet, egressing from the slit formed between the valve body and the valve seat or through the minute passages, and causes it to follow said surface in accordance with the known attached jet effect. The eventual direction of movement of the gas following the surface is therefore generally parallel to the axis of the flare conduit. The local pressure at the valve body surface is less than that of the ambient air, with the result that air flows toward the surface. The air is drawn into and mixes with the gas flow to provide a mixture which supports substantially smokeless combustion. Preferably, a tubular shroud member is mounted concentrically in spaced relation about the flow conduit outlet and the valve body. This shroud member has the effects of increasing the amount of ambient air drafted and helping to form the flame into an elongate shape. Preferably, means are provided to associate the valve body with the flow conduit and to dampen or slow the movements of the valve body toward or away from the valve seat. Such means may comprise a piston attached at one end of the valve body and having an opposite, enlarged end operating in a fluid-filled cylinder attached to the flow conduit and positioned along its axis. A narrow, annular passage is formed between the piston enlargement and the cylinder wall — this passage meters the movement of the fluid within the cylinder, thereby damping the up and down movements of the valve body. As a result, chattering of the valve body is greatly reduced and a stable flame is maintained.

The burner is characterized by several advantages. More particularly, it is adapted to approach substantially smokeless combustion without the need for forced feeding of gas or air — a requirement in other devices used in this service. Furthermore, it is adapted to accommodate varying gas flow rates while maintaining continuous, substantially smokeless combustion. The flame produced by the burner is pencil-like, with the result that heat radiation is not a serious problem. Finally, the burner is simple and inexpensive to build and maintain.

DESCRIPTION OF THE PREFERRED EMBODIMENT

Figure 1:
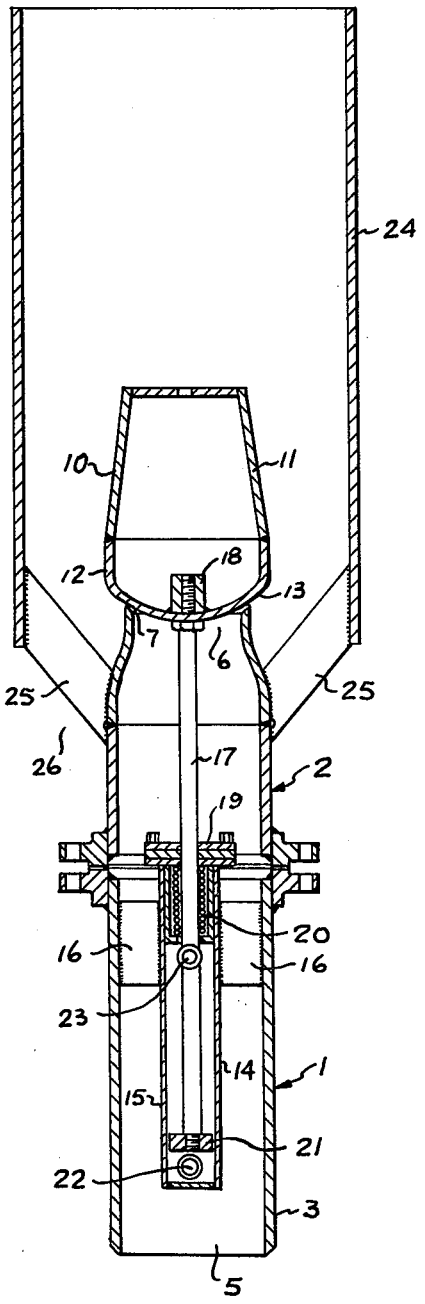
FIG. 1 is a side elevation, in section, showing the burner with the valve body seated.
Figure 2:
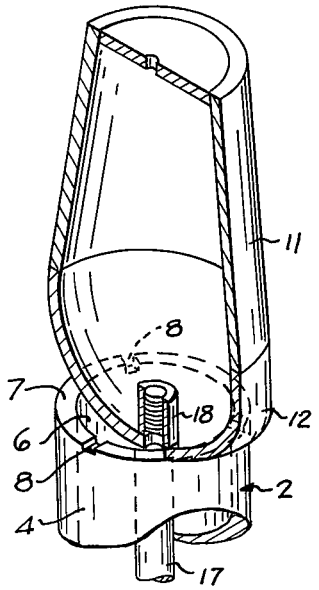
FIG. 2 is a perspective view, partly broken away, of the flow conduit and valve body, said conduit having transverse notches formed therein to provide minute passage means.

With reference now to FIGS. 1 and 2, the burner 1 comprises a tubular flow conduit 2 having inlet and outlet ends 3, 4 forming an inlet 5 and outlet 6 respectively. In use, the flow conduit 2 is attached to the end of a flare stack, not shown, to form an extension thereof.

Figure 3:
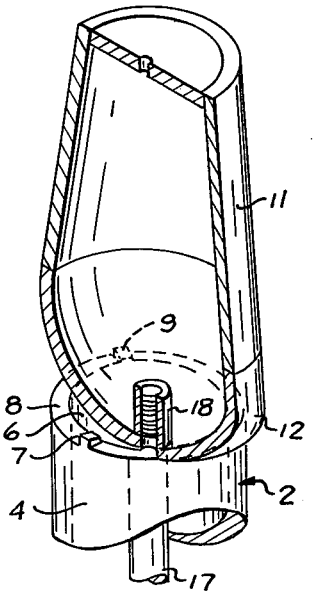
FIG. 3 is a perspective view, partly broken away, of the end of the flow conduit and valve body, said conduit having transverse lugs formed thereon to provide minute passage means between the conduit and valve body.
Figure 4:
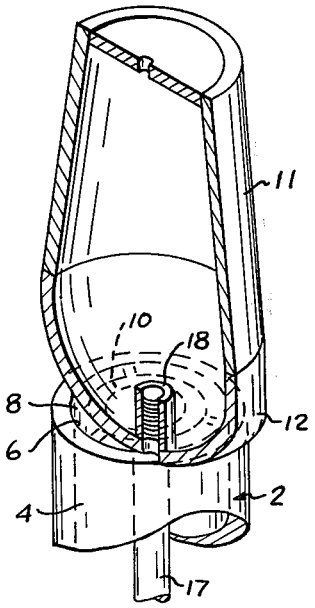
FIG. 4 is a perspective view, partly broken away, of the end of the flow conduit and valve body, wherein the valve body seats on a ring, mounted internally at the outlet of the conduit, to form a passage means in the form of a slit.
Figure 5:
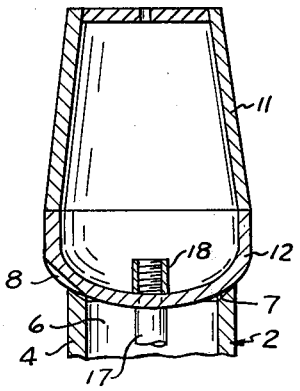
FIG. 5 is a sectional side view of the flow conduit and valve body, showing notches formed in the head to provide the minute passage means.

In the embodiment shown in FIG. 1, the end face of the outlet end 4 forms a coaxial valve seat 7. Minute passages 8 are provided at the outlet end 4 — as shown in FIG. 2, the passages 8 may consist of transverse notches cut across the valve seat 7. Alternatively, as shown in FIG. 3, the end face of the outlet end 4 may be formed with protruding, spaced lugs 9 whose upper surfaces form the valve seat 7. The gaps between the lugs 9 form the minute passages 8. In still another embodiment, illustrated in FIG. 4, the flow conduit 2 includes a concentric, internal ring 10 positioned in the outlet 6 of the flow conduit 2. The valve body 11 seats against this ring 10 and combines with the end face of the outlet end 4 to form the minute passage 8. In the embodiment shown in FIG. 5, the passages 8 are formed in the valve body 11.

In all of these alternative embodiments, the valve body 11 seats at the outlet end of the flow conduit 2 to restrict the gas flow, and minute passages 8 are provided at the outlet 6 to permit gas to escape from the flow conduit.

The valve body 11 is generally tulip-shaped. It has a base portion 12 whose solid surface 13 extends outwardly from the flow conduit 2 and curves to join a tapered portion 14 which extends generally in the direction of the longitudinal axis of said conduit. The shape of the valve body 11 is selected to cause gas leaving the flow conduit 2 to adhere to it and form an attached jet in accordance with what is known as the attached jet or Coanda effect. In the embodiment illustrated in the drawing, the valve body 11 is drawn to scale and, in a four inch burner, comprises a standard five inch weld cap to provide the base portion.

The axial displacement of the valve body 11 is dampened or slowed by an assembly 14. The assembly 14 comprises an oil-filled tubular member 15 closed at its lower end and suspended coaxially within the flow conduit 2 by gussets 16. A shaft 17, connected to the valve body 11 at its upper end by a screw 18, extends into the tubular member 15. The upper end of the member 15 is closed by Teflon (trade mark) seals 19, which embrace the shaft 17 to provide a liquid-tight seal. A ball bushing 20 is positioned around the shaft 17 to centralize it within the member 15. An enlargement 21 is formed on the lower end of the shaft 17 to retard the flow of oil from one end of the tubular member 15 to the other when the valve body 11 and attached shaft 17 are moving axially. Ports 22, 23, for filling the tubular member 15 with oil and bleeding off air, are provided to complete the assembly 14. These ports 22, 23 are normally closed with plugs (not shown).

A tubular shroud member 24 is connected with the flow conduit 2 by gussets 25. As shown, the shroud member 24 surrounds the flow conduit outlet end 4 and the valve body 11 in spaced, concentric relationship and extends longitudinally beyond the upper end of said body.

In operation, the flow conduit 2 is attached to the end of the flare stack so that the gas to be flared enters the inlet 5. In a natural gas plant operation, it is desirable to keep the back pressure in the flare line as low as possible. Therefore the weight of the valve body 11 and shaft 17 are selected to permit the body to unseat at a low back pressure, for example 1 psi. At low gas flows, such as for example 50,000 cubic feet per day, the valve body 11 usually remains seated in the valve seat 7, since the back pressure is too low to displace it axially. The gas then escapes from the flow conduit 2 through the minute passages 8. As it passes through the constrictive passages 8, the gas accelerates. Moving at relatively high velocity, it forms an attached jet which follows the curved contour of the valve body 11 as a thin layer. As this takes place, a low pressure condition is developed at the surface of the valve body 11, which draws in air through the bottom opening 26 of the shroud member 24. This air mixes with the gas to provide a mixture which, when ignited, burns substantially smokelessly. As the gas flow increases, the pressure in the flare stack also increases and lifts the valve body 11 off its seat 7, thereby allowing the gas to escape at a increased rate.

By providing the minute passages 8, the attached jet of gas and draft of air are maintained continuously, thereby ensuring a stable, continuous flame. If combustion is interrupted, there is a danger in cold climates that the valve body 11 would freeze to the outlet end 4. In addition, the passages 8 provide a means for bleeding off the flare line in the event that it is to be repaired.

By providing the damping means, chattering of the valve body 11 against the valve seat 7 is greatly reduced. By slowing the movements of the valve body 11, changes in the gas flow around the body occur more gradually, thereby improving the stability of the flame.

We have developed a series of dimensional relationships which we use in designing our novel burners. These relationships are given below for a four inch outlet diameter burner — however it is to be understood that they may be departed from and are not to be considered as limitations on the invention. They are merely provided as a useful guide in designing an efficient embodiment:

TABLE I

Figure 6:
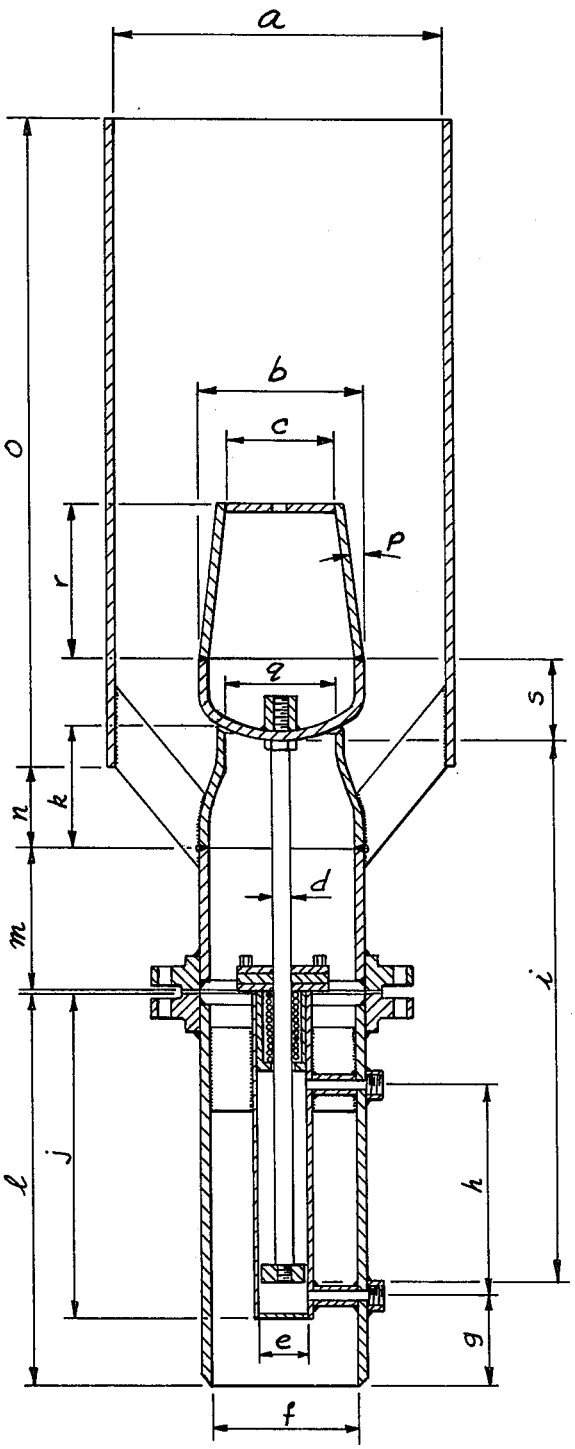
FIG. 6 is a side elevation, in section, showing the burner with its various parts labelled to identify dimensions given in Table I.
Figure 7:
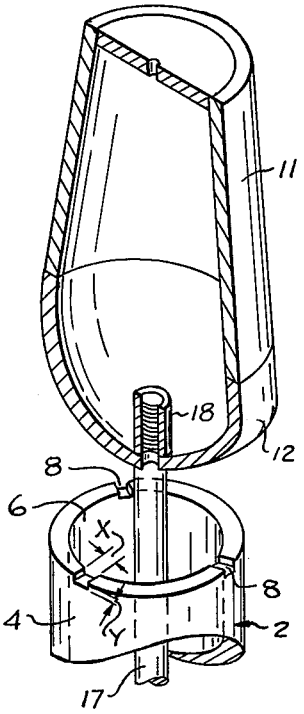
FIG. 7 is a perspective, partly broken away view of the flow conduit and the unseated valve body, having the notch dimensions labelled.

| Burner parameters with reference to FIG. 6 | |
|---|---|
| q = flow conduit outlet diameter | = 4" |
| b = 1.41 q or next pipe size | = 5⅝" |
| c = b − 2 r tan P | = 3¾" |
| r b | = 6" |
| s .5b | = 3" |
| P = 7½° | |
| d = 1" | |
| e = 2" | |
| f = next pipe size larger than q | = 6" |
| g = 4" | |
| h = 7¼" | |
| i = 22½" | |
| j = 12" | |
| k = 5½" | a = 12" |
| l = 16" | o = 36" |
| n = k − l = 4½" | |
| m = 10½ − k = 5" | |
| ratio of $\frac{\text{cylinder area}}{\text{outside area of orifice block}}$ | = 1.068 |

A four inch burner in accordance with Table I was tested in the field by flowing gas therethrough at varying rates, as follows:

| Flow Rate MMSCF/day | | Back pressure at tip (psig) | gas temp. °F |
|---|---|---|---|
| 0.11 | | .25 | 110 |
| 0.14 | | .56 | 100 |
| 0.20 | valve open | .76 | 110 |
| 0.24 | | .90 | 93 |
| 0.24 | | .97 | 60 |
| 0.24 | | 1.08 | 80 |
| 0.57 | | 1.26 | 50 |
| 0.59 | | 1.37 | 55 |
| 2.43 | | 2.08 | 44 |
| 2.44 | | 1.91 | 38 |
| 3.34 | | 2.71 | 42 |
| 3.42 | | 3.61 | 63 |
| 3.45 | | 2.46 | 48 |
| 3.53 | | 3.07 | 52 |
| 4.08 | | 3.18 | 62 |

These data indicate that the burner was able to burn varying flows of gas at a generally low back pressure. During the test, substantially smokeless burning was obtained following the first two readings.

Obvious variations in the specific constructional details described may be made without departing from the spirit of the invention and such embodiments of the invention as come within the scope and purview of the appended claims are to be considered as part of this invention.

What is claimed is:

1. In a burner comprising an axially movable substantially free floating coanda valve body positioned at the outlet of a tubular flow conduit for regulating the flow of combustible gas out of the outlet so as to maintain a substantially constant back-pressure within the conduit, the improvement which comprises:

means connecting the coanda valve body and the conduit for providing substantially equal dampening of the axial movement of the valve body toward and away from the outlet, thereby reducing "chattering" of the valve body and improving the stability of the flame; and said burner having one or more minute passages, extending from the interior of the flow conduit and directed toward the valve body, said passages being so dimensioned that gas passing through the flow conduit at a low flow rate, escapes from the conduit at sufficiently high velocity when the valve body is seated, to cause the escaping gas to follow the coanda valve body surface and entrain air.

2. The improvement as set forth in claim 1 wherein:

said dampening means comprises a fluid-filled tubular damping member mounted within the flow conduit and having a closed lower end;

a shaft connected to the valve body and extending into the damping member;

means carried by the damping member and engaging the shaft to seal the fluid within the damping member;

said shaft having an enlargement at its inner end for slowing the movement of the fluid thereby when the shaft and valve body are axially displaced, whereby the movement of the valve body is dampened.

* * * * *